United States Patent [19]

Kolk, Jr.

[11] 4,150,172

[45] Apr. 17, 1979

[54] METHOD FOR PRODUCING A SQUARE LOOP MAGNETIC MEDIA FOR VERY HIGH DENSITY RECORDING

[76] Inventor: Anthony J. Kolk, Jr., 27011 Eastvale Rd., Palos Verdes Peninsula, Calif. 90274

[21] Appl. No.: 918,490

[22] Filed: Jun. 23, 1978

Related U.S. Application Data

[63] Continuation of Ser. No. 800,642, May 26, 1977.

[51] Int. Cl.[2] ..... C23C 3/02

[52] U.S. Cl. ..... 427/129; 427/130; 427/131; 427/132; 427/305; 428/658; 428/650; 428/668; 428/680; 428/928

[58] Field of Search ..... 427/127, 128, 131, 405, 427/129, 130, 132, 305; 428/928, 926, 650, 651, 668, 680, 626, 630, 635, 658

[56] References Cited

U.S. PATENT DOCUMENTS

| | | | |
|---|---|---|---|
| 3,180,715 | 4/1965 | Simon | 427/131 |
| 3,350,180 | 10/1967 | Croll | 428/635 |
| 3,466,156 | 9/1969 | Peters et al. | 427/131 |
| 3,702,239 | 11/1972 | Nagy et al. | 428/668 |
| 3,738,818 | 6/1973 | Stone et al. | 428/650 |

*Primary Examiner*—Arthur J. Steiner
*Attorney, Agent, or Firm*—Linval B. Castle

[57] ABSTRACT

A magnetic recording film having high magnetic remanence and unusually good square loop characteristics at thicknesses of between one and five microinches can be deposited directly on non-magnetic electroless nickel from an electroless bath containing cobalt ions, citrate ions, hypophosphite ions, phosphate ions and, if desired, nickel ions. The electroless bath may also contain an ethanolamine, or mixture thereof, as a wetting agent and brightener. The coercive force of the magnetic recording film can be selected to lie between 300 and 1,000 oersteds by adjusting the pH of the bath. Thicker structures with good square loop characteristics and high coercive force can be prepared by the successive plating of two or more magnetic thin films separated by thin films of non-magnetic nickel-phosphorus.

3 Claims, 2 Drawing Figures

METHOD FOR PRODUCING A SQUARE LOOP MAGNETIC MEDIA FOR VERY HIGH DENSITY RECORDING

This is a continuation of application Ser. No. 800,642, filed May 26, 1977, now abandoned.

BACKGROUND OF THE INVENTION

This invention relates to magnetic recording media, and more particularly to an electroless deposition process for producing magnetic recording films having substantially square hysteresis characteristics and magnetic coercivity values that may be adjusted in the plating bath to lie in the range of 300 to 1,000 oersteds.

The electroless deposition process of the invention is particularly useful for the manufacture of large capacity digital computer memory systems, such as magnetic memory discs. The reading and writing of information on the surface of a memory disc is usually accomplished by a magnetic transducer in a flying head which supports the transducer at a carefully controlled and very close spacing to the surface of the disc. During writing operations, the magnetic transducer converts the electrical input current pulses into a bidirectional magnetic field which then locally changes the direction of the magnetic flux in the film of magnetic medium on the disc surface. During the reading operation, the flux reversals in the magnetic medium are converted by the transducer into an electrical voltage output pattern.

It is common practice to manufacture magnetic memory devices, such as memory discs, on an aluminum substrate. When the magnetic media is a metallic film, the aluminum substrate is first coated with a hard non-magnetic layer upon which is deposited the magnetic recording media layer, generally a cobalt-phosphorus or cobalt-nickel-phosphorus alloy. It is also common practice to overcoat the magnetic layer to protect it from oxidation and physical damage. Although electroplating has occasionally been employed to form the layers in the magnetic structure, electroless deposition is usually preferred because it lends itself to batch processing of many memory discs at one time in a single plating tank.

In the past, the general practice has been to deposit the magnetic thin films at thicknesses greater than 5 or even 10 microinches since the voltage output is related to the thickness of the magnetic layer and since it was desired to obtain higher output voltages from the media. However, it has been found that greatly improved performance is obtainable with much thinner magnetic films in order to record the magnetic information at a greater density along the track of the flying head. In order to obtain a high packing density such as 5,000 bits per inch, or more, metallic films of 5 microinches in thickness or less are necessary. However, because the reduced thickness of the film will reduce the signal output from the magnetic medium, the thin film must possess very good magnetic hysteresis loop qualities to prevent further degradation of the output signal. The magnetic hysteresis loop characteristics which are important include the magnetic remanence, the coercive force, and the loop shape, which is often referred to as the squareness.

It is most desirable that the sides of the hysteresis loop be made as vertical as possible in order to reduce the time required for a recording transducer to switch the direction of the magnetic flux in the film. If the transducer time is negligible compared with the movement of the magnetic media during writing, the slope of the loop sides would not be important. However, in high-speed recording where the transducer is required to switch its magnetic field at a very high rate, then sloping sides of the hysteresis loop causes the magnetic flux change to be smeared by the motion of the media, thereby resulting in a readout signal that is quite low compared with that from a media having a hysteresis loop with nearly vertical sides. It can be seen, therefore, that the design of a magnetic memory system represents a compromise between information packing density, voltage output signal, and writing currents as determined by the hysteresis loop properties which govern these parameters.

The invention described and claimed herein provides an improved magnetic recording media having a high remanent magnetization and good hysteresis loop characteristics so that the highest values of coercive force can be employed together with good resolution. Specifically, the invention provides magnetic films in which the remanent magnetization is higher than 10,000 gauss, and the coercive force can be selected to lie between about 300 and 1,000 oersteds while the slope of the sides of the hysteresis loop are substantially vertical even though the magnetic film thickness is less than 5 microinches.

Broadly, the plating process used in my invention includes the following prior art steps: First, a cleaned aluminum substrate is plated with a very thin layer of zinc and then placed in an electroless nickel bath which is so formulated that a high-phosphorus content, non-magnetic nickel is deposited to a thickness of at least 60 microinches. The nickel-coated substrate is then applied to an electroless bath and a cobalt-phosphorus magnetic layer is deposited on the nickel surface. The above broadly outlined process has been found satisfactory for producing thick magnetic layers for low packing density recording. However, the above process has, in the past, presented many problems when magnetic coatings of a thickness approximately 5 microinches or less are required. The most prominent problem is that it has been difficult, if not impossible, to obtain square hysteresis loop characteristics from the deposition of a magnetic film directly upon the surface of the non-magnetic nickel. To obviate this difficulty, U.S. Pat No. 3,738,818 describes a process in which a thin layer of gold is deposited between the non-magnetic nickel and the magnetic cobalt layers. This process produces excellent results but introduces the complication of an additional step in the process as well as the added cost for the gold deposition.

The process of my invention eliminates the need for the intervening gold deposition step in the aforementioned patent and provides a magnetic coating with comparable characteristics by depositing directly upon the non-magnetic nickel layer a magnetic cobalt or cobalt nickel phosphorus film with thicknesses of 5 microinches or less down to approximately 1 microinch. At thickness less than 1 microinch it becomes difficult to maintain the unusually good loop shape characteristic of slightly thicker films. An important feature of the invention is that the electroless magnetic film bath possesses unusual stability with respect to short-term variations in the magnetic properties of the films produced therein, and the bath has been demonstrated to be capable of being used almost daily for several weeks without deterioration. The bath parameters affecting the magnetic properties are typically adjusted at the beginning of a work day and then remain stable throughout the day, provided, however, that the work load is such that there is no significant change in the hypophosphite level in the bath. This is in contrast to electroless magnetic plate baths containing ammonia as one of the constituents so that volatization of this constituent necessitates frequent replenishment. In those prior art baths containing the volatile ammonia, there are substantial changes in the coercive forces of the magnetic films produced in the bath because of the continual change in the pH of the bath. These pH changes produce problems of reproducibility of magnetic properties as well as the degradation in loop shape of the magnetic media produced during a single plating run.

The absence of volatile constituents, such as the ammonia used in prior art electroless plating processes, provides an additional feature of the invention. While the invention is primarily directed toward producing a magnetic layer for recording with good square loop properties at thicknesses approximately 5 microinches or less, the process can also be used to produce thicker magnetic structures with controlled high coercive force and equally good loop shapes by alternating thin layers of magnetic films with thin layers of electroless non-magnetic nickel. Heretofore, it has been extremely difficult to produce thick structures by this multi-layering technique because the volatization of the ammonia in the electroless bath caused rapid changes in the coervice force in the several films and resulted in creating poor hysteresis loop characteristics in the composite structure.

BRIEF DESCRIPTION OF THE INVENTION

Briefly described, the invention is for an electroless plating process for producing magnetic thin films having square hysteresis loop characteristics and a coercivity that can be selected to lie between 300 and 1,000 oersteds by adjusting the pH of the plating bath. The magnetic film of cobalt-phosphorus or cobalt-nickel phosphorus can be applied directly over a layer of non-magnetic nickel and the bath contains no volatile constituents that can rapidly alter the magnetic properties of magnetic films deposited during the same run. As a result, the process may be used to produce multi-layer structures of alternate magnetic and non-magnetic layers and each magnetic layer therein will have substantially identical magnetic characteristics. The process is particularly suitable for the magnetic plating of computer memory discs which may be recorded at bit densities in excess of 5,000 bits per inch along each magnetic track.

DETAILED DESCRIPTION

Figure 1:
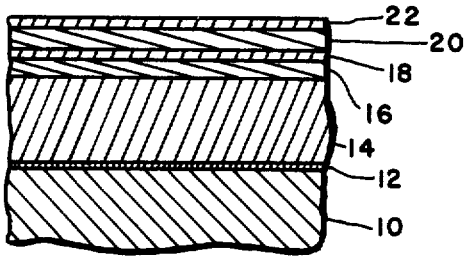
FIG. 1 is an elevation view illustrating the various layers in a recording media made in accordance with the invention.

Turning now to a detailed description of the invention, FIG. 1 is an elevation view illustrating the various layers plated on a substrate 10. In the description to follow, the substrate 10 will be assumed to be an aluminum alloy disc upon which will be plated a magnetic medium for use as a digital computer memory. It will be understood that the substrate 10 may, if desired, be of any other material, such as glass or plastic. Substrate 10 is suitably lapped, polished and then de-greased and cleaned to receive a thin flashed layer of zinc 12 which, in turn, supports a layer 14 of non-magnetic electroless nickel deposited to a thickness of 60 microinches or more. A magnetic cobalt layer 16 is then deposited from an electroless bath to the surface of the non-magnetic nickel layer 14. The magnetic cobalt layer 16, which is deposited to a thickness of between 1 and 5 microinches, supports a second layer 18 of non-magnetic nickel which is deposited to a thickness of between 1 and 2 microinches as a protective covering for the cobalt layer 16.

If it is desired to produce a thick film from several thin film layers, another equally thick layer of magnetic cobalt 20 along with a second protective nickel layer 22 may be applied to the non-magnetic nickel layer 18. As previously discussed, additional thin magnetic cobalt layers may be applied over thin non-magnetic nickel layers to produce thick magnetic structures having the square hysteresis loop characteristics of the individual thin magnetic layers.

Figure 2:
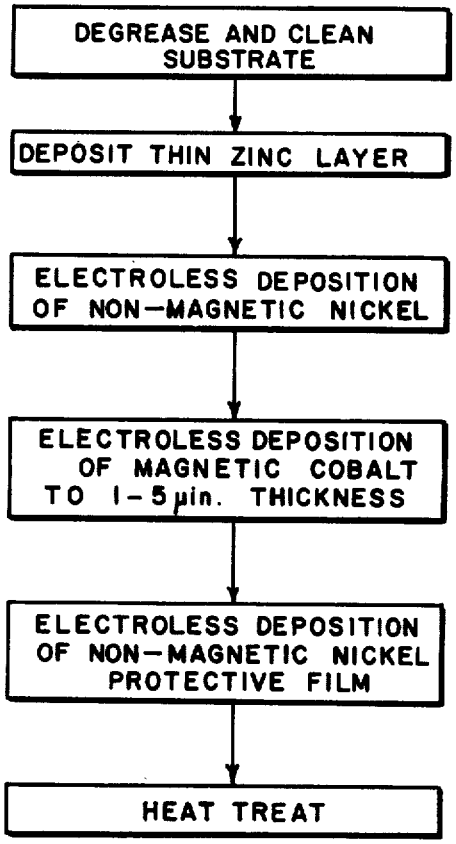
FIG. 2 is a block diagram illustrating the process steps for producing an aluminum based structure containing the electroless plated magnetic medium deposited in accordance with the invention.

FIG. 2 illustrates the various plating steps in the process of applying a magnetic coating to an aluminum disc to produce a computer memory disc capable of very high packing densities in the order of 5,000 bits per inch or better. As illustrated in FIG. 2, the initial step in the process is to de-grease the substrate with an organic solvent and then clean the disc with a non-etching aluminum cleaner followed by a spray rinse of distilled water.

After cleaning, the substrate is subjected to a zincating process to form a thin zinc layer on the substrate surface. There are many commercially available zincating materials and processes, such as the well-known process described in the U.S. Pat. No. 3,216,835.

The zinc-coated substrate is then plated with electroless nickel using processes such as described in U.S. Pat. No. 2,876,116. Again, proprietary electroless nickel baths are commercially available for performing this step in the process. One variation from the standard practice in the performance of this step is that it is required that the pH be adjusted to a low level to maintain phosphorus content of the plate at a level above 10% so that the nickel is deposited in a non-magnetic composition. This can be achieved if the pH is kept at a level of about 4.15 measured at the bath operating temperatures of 80° C. The non-magnetic nickel layer is plated to a thickness of at least 60 microinches to both physically and chemically protect the aluminum substrate.

The nickel-plated substrate is followed by the formation of a magnetic cobalt layer from an electroless bath. The bath is prepared from appropriate sources of cobalt, hypophosphite, phosphate and citrate ions in approximately the following concentrations and ratios:

| | |
|---|---|
| $Co^{+2}$ | 2.5 g/l |
| $H_2PO_2^-$ | 3.5 g/l |
| $PO_4^{-3}$ | 5.5 g/l |
| $C_6H_5O_7^{-3}$ | 15.4 g/l |

The above ions must be added to water of high purity level to achieve consistent magnetic properties in the deposited material. If desired, an ethanolamine or a mixture of ethanolamines in a quantity of approximately 0.2 g/l to 2.0 g/l may be added to the bath to increase the brightness of the deposit and to act as a wetting agent. Also, if desired, some of the cobalt ions may be replaced by nickel ions to modify the deposit by forming a cobalt-nickel-phosphorus alloy. The bath temperature is preferably kept in the range of 82° to 85° C. and the pH measured at the operating temperature is generally kept between 8.3 and 8.55 depending upon the value of coercive force which is desired. In general, coercive force increases with increasing pH and decreasing thickness of the deposit. The other ions which may be present in the bath are introduced as necessary in order to utilize the most economical and commercially available chemicals in preparing the bath. These ions could be any neutral species such, for example, as sodium, potassium, sulfate, acetate, or chloride. Phosphite ion is formed by the oxidation of hypophosphite ion during the reduction of the metal and by other side reactions, but it causes no problems until the concentration becomes high—well in excess of 10 grams per liter. The phosphite ion may have favorable action of another buffer in the bath.

The correct pH to obtain the desired coercive force and the plating time should be determined by plating upon a dummy or sample substrate. The reason for this is that the plating rate and the coercive force are functions of the substrate geometry and the speed with which the substrate is rotated in the bath.

After the cobalt layer has been applied to the disc, the disc is given a protective coating of about 1 to 2 microinches of electroless nickel. The primary purpose of this coating is to protect the cobalt from oxidation. If the boundary layer lubricant, such as an oxide or chemical conversion coating, is desired to further protect the magnetic coating, the lubricant layer may be applied over the nickel.

The final step in the process is to bake the structure at a temperature of at least 135° C. but not higher than 280° C. The baking improves the adhesion of the deposited layers, increases the coercive forces and stabilizes the magnetic parameters.

EXAMPLE 1

In the first example, a 7075 aluminum alloy disc with a diameter of 14 inches and thickness of 0.075 inch was employed. The disc was first cleaned and de-greased with trichlorethylene and then mounted in a fixture which rotated the disc at a rate of 14 rpm. The disc was then further cleaned in a non-etching aluminum cleaner solution followed by a spray rinse in distilled water and the immersion in a 50% solution of nitric acid at room temperature for 15 seconds.

The disc was then zincated with a commercially available zincating solution containing 15 grams per liter of zinc ion. The disc was immersed in the solution for 10 seconds and then placed in a 50% nitric acid to remove the layer of zinc. The zinc was again immersed in the zincating solution for 6 seconds and rinsed. This process of double-zincating is intended to improve the uniformity and adhesion of the layer.

The disc was then rotated in a solution of a commercially available acid electroless nickel solution and adjusted to a pH of 4.15 at a bath temperature of 80° C. After a period of 90 minutes, which produced a layer of nickel phosphorus alloy of about 100 microinches in thickness, the disc was removed, rinsed, dried and carefully polished with a 1,200 grit polishing paper to remove any asperities from the nickel.

The disc was the sponged and spray-rinsed and then placed back into the nickel solution for 10 minutes, after which it was removed and rinsed in preparation for rotation in the cobalt bath.

The cobalt bath had the following composition:

| | |
|---|---|
| $CoSo_4 . 7H_2O$ | 12 g/l |
| Na Citrate . $2H_2O$ | 24 g/l |
| $NaH_2PO_2 . H_2O$ | 5.75 g/l |
| $K_2HPO_4$ | 10 g/l |
| Diethanolamine | 1.25 g/l |
| Monoethanolamine | 0.15 g/l |

The chemicals were added to the water and dissolved in the order listed. The pH was adjusted with sodium hydroxide solution to 8.3 at the bath temperature of 83° C. The disc was then placed in the solution, the rotation started, and left for a total of 80 seconds. The disc was then removed, rinsed, and placed in the nickel solution for another 90 seconds. The disc was then removed from the nickel solution, dried, and baked at 200° C. for 2 hours and then permitted to cool slowly in the oven at the rate of about 2° per minute until the temperature was below 100° C.

The flux level in the film was determined to be 0.07 maxwells per cm and the coercive force was 520 oersteds. At a remanence of 10,000 gauss, this flux would correspond to a thickness of 2.8 microinches.

EXAMPLE 2

The disc was prepared in a manner identical with Example 1 up to the point of the cobalt plating. The same cobalt bath was used but the pH level was increased to 8.4 at 83°. The disc was cobalt-plated as in Example 1 and then placed in the nickel bath but for only 80 seconds to form a non-magnetic nickel layer of between one and two microinches in thickness. The disc was then rinsed and returned to the cobalt tank for a second cobalt layer. The plating of the second cobalt layer and the subsequent processes were conducted as described in Example 1. The flux level was determined to be 0.1 maxwells per cm and the coercive force was 750 oersteds.

EXAMPLE 3

A disc was prepared in a manner identical with Example 1 up to the point of the cobalt plating. A cobalt-nickel bath with the following composition was used:

| | |
|---|---|
| $CoSo_4 . 7H_2O$ | 12 g/l |
| $NiSO_4 . 7H_2O$ | 2 g/l |
| Na Citrate . $2H_2O$ | 28 g/l |
| $NaH_2PO_2 . H_2O$ | 5.75 g/l |
| $K_2HPO_4$ | 10 g/l |
| Diethanolamine | 1.4 g/l |
| Triethanolamine | 0.5 g/l |

The pH was adjusted to 8.4 at a temperature of 83° C. The remaining procedure was conducted as in Example 1. The flux level in the disc was found to be 0.05 maxwells per cm and the coercive force was 650 oersteds.

What is claimed is:

1. A process for forming a high magnetic remanence recording film on the surface of a rigid substrate disc for magnetic recording at densities greater than 5,000 bits per inch, said process comprising the steps of:

(a) thoroughly cleaning said disc;

(b) zincating said cleaned disc to apply a thin layer of metallic zinc to the surface of said disc;

(c) rotating said zinc coated disc in an electroless nickel bath adjusted to a pH of 4.15 at 80° C. for a period sufficient to deposit a layer of non-magnetic nickel upon said zinc to a thickness of at least 60 microinches;

(d) rotating said nickel coated disc in an electroless cobalt deposition bath adjusted to a pH of between 8.25 and 8.65 at a temperature of between 82° and 85° C., said bath containing cobaltous ions, citrate ions, hypophosphite ions, phosphate ions, and an ethanolamine wetting agent and brightener, said disc being rotated within said bath for a period sufficient to produce on said non-magnetic nickel layer a layer of magnetic cobalt having a thickness of between one and five microinches;

(e) returning said cobalt plated disc for rotation within said electroless nickel bath for a period sufficient to provide an adherent protective nickel coating having a thickness of between one and two microinches; and (f) drying and baking said disc at a temperature of between 135° to 280° for a period of approximately two hours.

2. The process claimed in claim 1 wherein said rigid substrate is an aluminum alloy.

3. The process claimed in claims 1 or 2 wherein the step (d) of rotating said nickel coated disc is performed in a deposition bath wherein a portion of the contained cobaltous ions are replaced with nickel ions to form a magnetic cobalt-nickel phosphorus alloy having a thickness of between one and five microinches.

* * * * *